US005868367A

United States Patent [19]

Smith

[11] Patent Number: 5,868,367

[45] Date of Patent: Feb. 9, 1999

[54] RAPID-DEPLOYMENT DISPLAY STAND

[75] Inventor: Michael J. Smith, Orangeburg, N.Y.

[73] Assignee: Arrow Art Finishers, L.L.C., Bronx, N.Y.

[21] Appl. No.: 730,231

[22] Filed: Oct. 15, 1996

[51] Int. Cl.[6] ..... A47B 97/08

[52] U.S. Cl. ..... 248/174; 248/459; 211/73

[58] Field of Search ..... 248/174, 459, 248/346.3, 165; 211/135, 149, 73

[56] References Cited

U.S. PATENT DOCUMENTS

| | | | |
|---|---|---|---|
| Re. 32,668 | 5/1988 | Smith | 248/174 X |
| 1,717,456 | 6/1929 | Lasher, Jr. | 248/174 |
| 2,075,919 | 4/1937 | Wagner et al. | 248/459 |
| 2,797,815 | 7/1957 | Gorman | 248/174 X |
| 3,300,166 | 1/1967 | Wojciechowski | 248/174 |
| 3,738,604 | 6/1973 | Howlett et al. | 248/174 X |
| 3,836,104 | 9/1974 | Miller et al. | 248/174 X |
| 4,546,941 | 10/1985 | Hildebrand | 248/174 |
| 4,570,805 | 2/1986 | Smith | 248/174 X |
| 4,619,426 | 10/1986 | Drueck, Jr. | 248/174 |
| 4,875,737 | 10/1989 | Cardenas | 248/174 X |

FOREIGN PATENT DOCUMENTS

| | | | |
|---|---|---|---|
| 1254983 | 1/1961 | France | 248/174 |

*Primary Examiner*—Leslie A. Braun
*Assistant Examiner*—Stephen S. Wentsler
*Attorney, Agent, or Firm*—Kirschstein, et al.

[57] ABSTRACT

A display stand includes a main body of a sleeve-shaped configuration including a first main portion, a second main portion, a pair of foldable side portions pivotably interconnecting the first and second main portions, a first auxiliary portion pivotably connected to the first main portion and extending across at least a part of the open upper end of the tubular formation in the erect condition, and a second auxiliary portion pivotably connecting the first auxiliary portion and depending down from the first auxiliary portion in the erect condition. At least one elastic element is connected to and extends between the lower end of the second main portion and the second auxiliary portion. This element acts directly on the second auxiliary portion and only through the same on the other portions.

4 Claims, 4 Drawing Sheets

19a
18c
19c
18a
14
19f
10
18d
19d
18b
19b
25a
28a
24a
24b
22e
19e
18e
25b
28b
26a
15a
20e
13
15c
26b
16d
15f
16a
16f
16c
15b
15d
15e
16e
16b

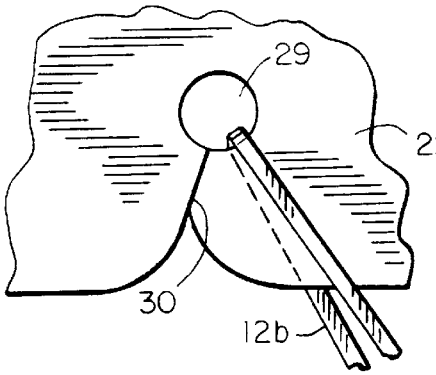
FIG. 6
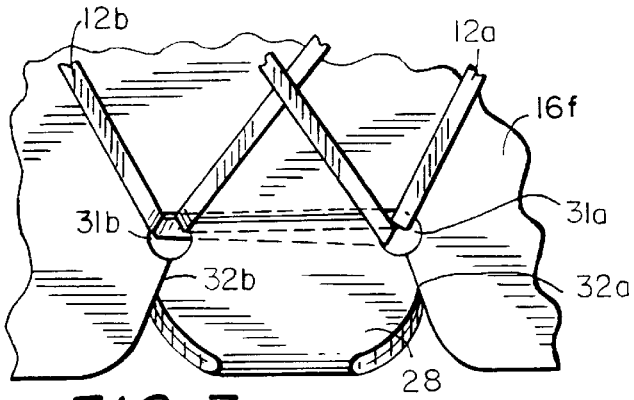
FIG. 7
FIG. 5
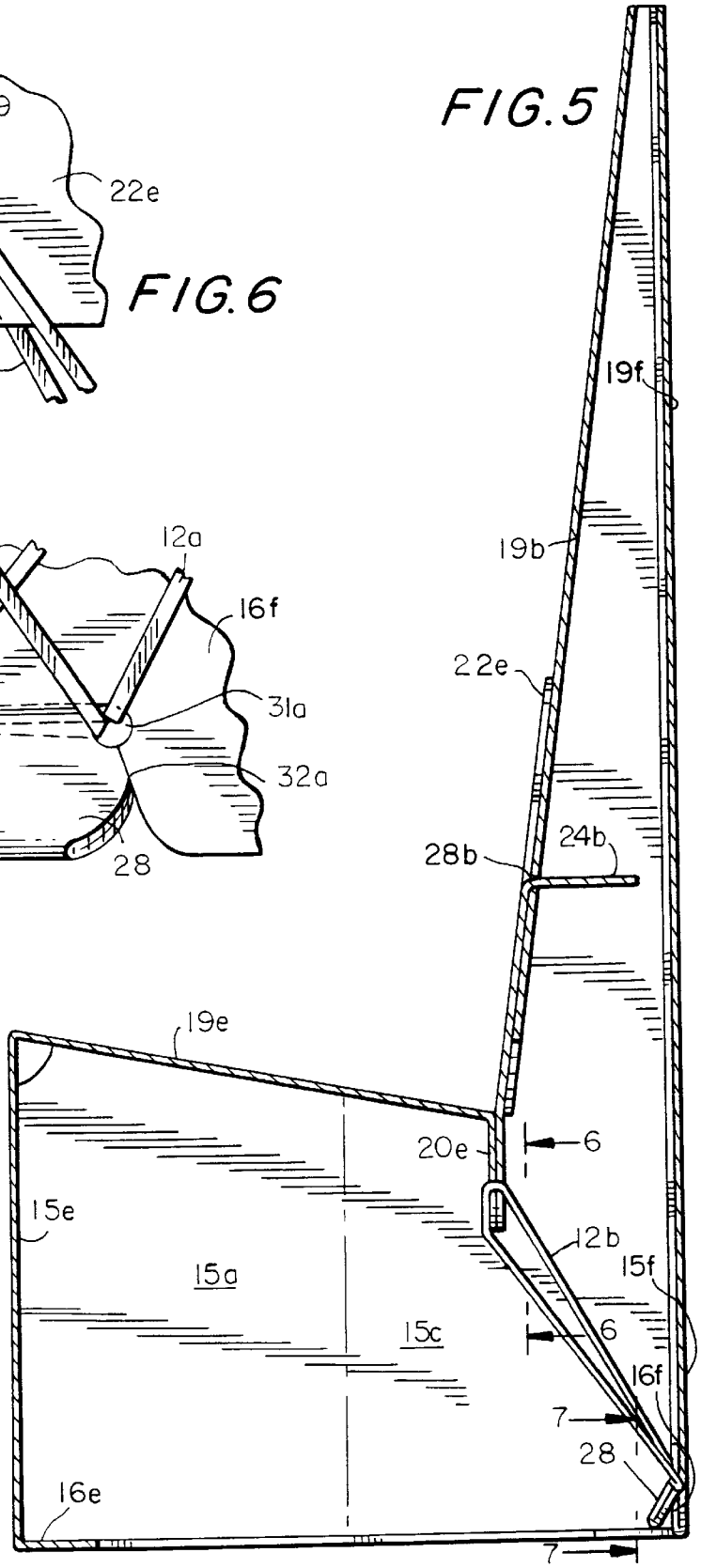

RAPID-DEPLOYMENT DISPLAY STAND

BACKGROUND OF THE INVENTION

1. Field of the Invention

The present invention relates to display stands in general, and more particularly to a display stand capable of prominently displaying the items being offered for sale that is capable of rapid and reliable automatic deployment at the site of and just prior to its use.

2. Description of the Related Art

There are already known various constructions of merchandise display stands, among them such that include respective main portions and foldable side portions that are pivotably connected with said main portions to constitute with them a sleeve-shaped formation, as well as other portions that complement the aforementioned portions and form various item-supporting shelves, platforms or other parts that give the display stand its desired final appearance in the erect condition of the display stand.

It has been also proposed, in order to facilitate the erection process, to interpose one or more elastic elements between certain portions of the display stand such that they are more tensioned in the folded, collapsed position than in the erect position of the display stand. So far, however, such certain portions have been either the foldable side portions themselves, or such side portions and some partitioning walls situated in the space bounded by the tubular formation. Examples of such display stands can be found, for example, in U.S. Pat. Nos. 4,646,922; No. 4,723,664; and Re. 32,668.

Experience with at least some display stand constructions employing this principle has shown, however, that this solution leaves much to be desired. The most prominent of the problems encountered in this respect with the prior constructions was that most, if not all, of the available energy accumulated in the elastic element or elements when the display stand is in its folded condition is spent during the deployment of the display stand on overcoming the resistance to movement of the portions constituting the tubular formation and/or the partitioning portions, if any. There is not much stored available energy left for causing the movement of the other portions, especially any item-supporting platforms that may be provided, toward their desired final positions. The end result in many instances is an incomplete deployment of the display stand, which requires extensive and hence cumbersome human intervention for its completion. This, of course, is highly undesirable.

OBJECTS OF THE INVENTION

Accordingly, it is a general object of the present invention to avoid the disadvantages of the prior art.

More particularly, it is an object of the present invention to provide a display stand that does not possess the drawbacks of the known display stands of the aforementioned type.

Still another object of the present invention is to devise a display stand of the type here under consideration which is capable of relatively rapid, but mainly reliable, self-deployment at the point of use.

It is yet another object of the present invention to design the above display stand in such a manner as to promote the movement of the crucial portions of the display stand toward their final positions over those performing supporting roles.

A concomitant object of the present invention is so to construct the display stand of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display stand comprising: a main body of a sleeve-shaped configuration including a first main portion, a second main portion, and a pair of foldable side portions pivotably interconnecting the first and second main portions with one another for movement between a collapsed condition in which all of the portions extend along a common plane, and an erect condition in which the folded side portions are unfolded and extend substantially normal to the first and second main portions. All the portions together form a tubular formation having a lower end and an open upper end as considered in an orientation assumed by the display stand when in use.

In addition to that, the main body includes a first auxiliary portion pivotably connected to the first main portion and extending also along the common plane in the collapsed condition and across at least a part of the open upper end of the tubular formation in the erect condition, and a second auxiliary portion pivotably connected to a region of the first auxiliary portion that is remote from the first main portion and also extending along the common plane in the collapsed condition while depending down from the first auxiliary portion in the erect condition.

Last but not least, the display stand includes at least one elastic element connected to, and extending between, the lower end of the second main portion and the second auxiliary portion and operative for directly acting on the latter to pull the same, and with it the first auxiliary portion, across the upper end, and the first main portion only through the medium of the auxiliary portions away from the second main portion with attendant opening up of the upper end and unfolding of the side portions.

A particular advantage of the display stand as described above is that the energy accumulated in the elastic element is first applied where it matters the most: to the movement of the first and second auxiliary portions across the top end of the tubular formation. Once the full brunt of this energy burst is applied in the above manner, there is plenty of energy left over to mediately move the various parts of the tubular formation toward their final positions in the fully erected condition of the display stand.

Advantageously, the first auxiliary portion rests on the upper end of the tubular formation in the erect condition to constitute a platform on which items to be displayed can reliably rest while on public display on the display stand in the erect orientation of the latter.

According to another advantageous facet of the present invention, the foldable side portions have extensions that extend upwardly beyond the rest of the upper end at the second main portion. Under these circumstances, the second auxiliary portion is situated at, and in abutment with, the extensions as the stand approaches, and as and after it has reached, its erect condition.

In this context, it is further advantageous to provide a third auxiliary portion pivotably connected to the second auxiliary portion at a region of the latter remote from the first auxiliary portion. The third auxiliary portion also extends along the common plane in the folded condition, and upwardly from the second auxiliary portion in the erect condition, to slide along the extensions of the side portions as the stand approaches its erect condition. Then, the display stand may further include a pair of additional portions each pivotally connected to one of the extensions of the side portions and both extending in juxtaposition with the third auxiliary portion at the same side thereof as the second main portion. A particularly advantageous combination of features is obtained when the second main portion has an extension as well, extending between and pivotably connecting the extensions of the side portions with one another, and/or when there is provided means for locking the aforementioned portions in positions in the erect condition of the display stand.

According to another aspect of the present invention, the elastic element is an endless element, and the second auxiliary portion and the lower end of the second main portion both have respective engagement regions around which the endless elastic element is trained.

There may also be provided at least one other elastic element similar to the one elastic element and extending between the lower end of the second main portion and the second auxiliary portion but along a trajectory differing from that of the one elastic element. In this connection, it is especially advantageous when the trajectories of the one and the other elastic element diverge from one another in a direction from the lower end of the second main portion to the second auxiliary portion.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 5 is a vertical sectional view taken along lines 5—5 of FIG. 4;

FIG. 6 is a magnified fragmentary view of a detail of the display stand taken on line 6—6 of FIG. 5; and FIG. 7 is a view akin to that of FIG. 6 but taken on line 7—7 of FIG. 5.

DETAILED DESCRIPTION OF THE PREFERRED EMBODIMENT

Figure 1:
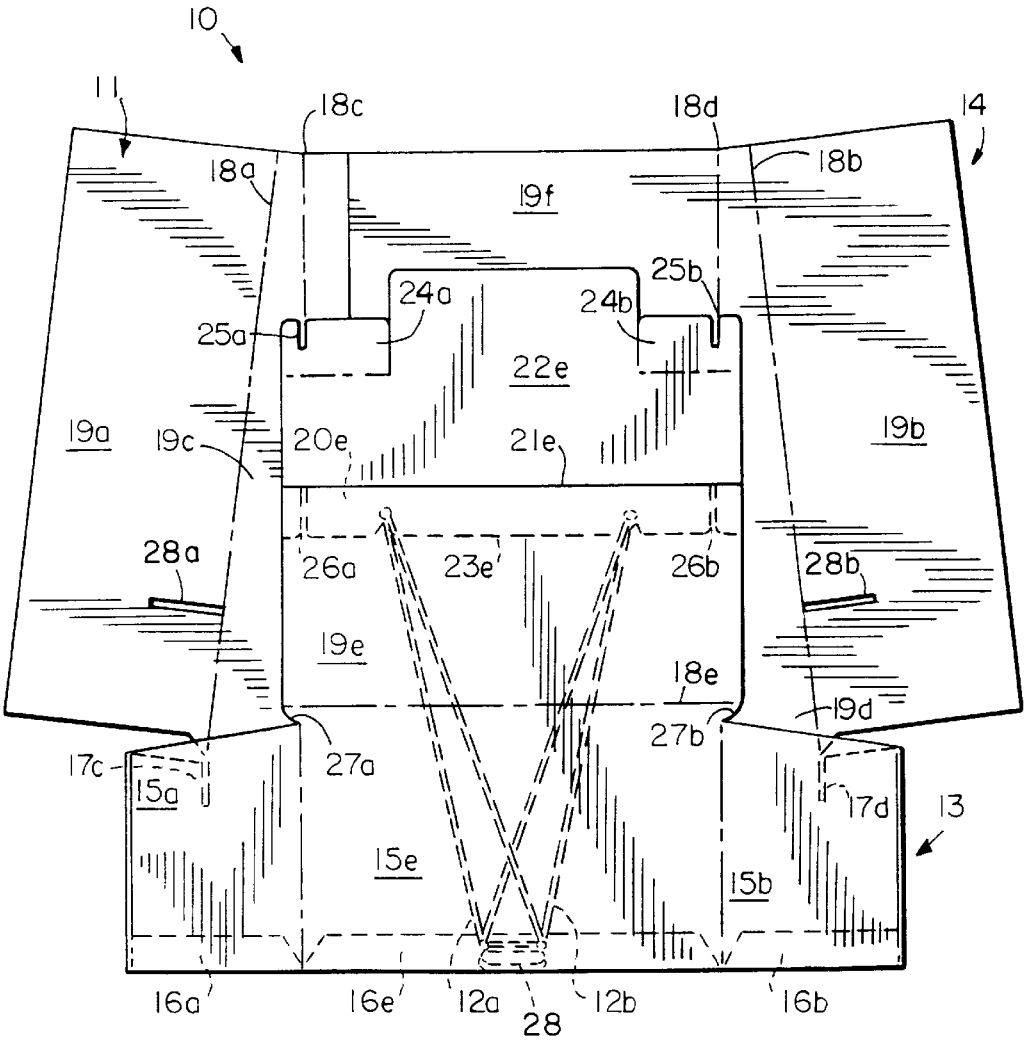
FIG. 1 is a front elevational view of a display stand of the present invention in its flat collapsed state.
Figure 3:
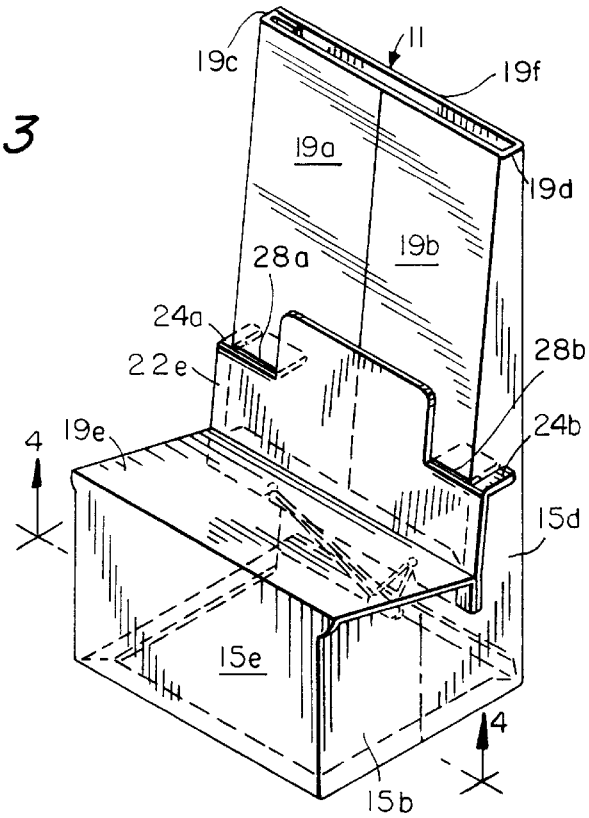
FIG. 3 is a view similar to that of FIG. 2 but on a smaller scale and showing the display and in its fully deployed condition.

Referring now to the drawing in detail, and first to FIG. 1 thereof, it may be seen that the reference numeral 10 has been used therein to identify a display stand of the present invention in its entirety. The display stand 10 includes as its main constituent component a main body 11, and as its only other components of consequence two resilient elements 12*a* and 12*b*, wherein the suffixes a and b (as well as suffixes c and d that will be used in addition to them when warranted by circumstances) have been used, and will be used throughout this detailed description, to indicate that the part or portion in question is located at or associated with the left side (for the suffixes a and c) or the right side (as far as the suffixes b and d are concerned) of the display stand 10 as considered in FIG. 1 of the drawing. On the other hand, the suffixes e and f have been reserved for the parts or portions of the display stand 10 that are located at the front and at the back of the display stand 10 when it is in its fully deployed condition that is depicted in FIG. 3 of the drawing.

It may just as well be said at this juncture that this convention, that is the use of the orientation and/or position of the display stand 10 as illustrated in FIG. 1 and elsewhere in the drawing, will be adhered to throughout this description with respect to the diverse directions or mutual relative positions of the various components, parts or portions of the display stand 10; however, it is to be understood that the principles of the present invention as they will be described below could also be easily, with only some minor and insignificant modifications, be utilized in different display stand structures that would not strictly follow this convention.

Moreover, it also ought to be mentioned here that, inasmuch as the elements and portions designated with the suffixes a to d are paired with one another, that is each of them has its counterpart (usually but not necessarily a substantially identical mirror-image replica of itself) on the other side of the display stand 10, these and only these parts or portions will, for the sake of brevity and clarity and unless introduced for the first time or otherwise called-for by the circumstances, either be described with reference to only one of them with the proviso that such description is equally or equivalently applicable to the respective other of them as well, or referred to by merely the respective reference numeral without adding any suffixes to it, in which case the parts or portions with the e and f suffixes will obviously not be included in this collective designation.

The main body 11 is made of corrugated board, cardboard or similar sheet material of the type customarily used for the manufacture of shipping boxes, display stands and/or other containers or structures of a similar character. This material should be sturdy enough to be able to withstand the steady or impact forces to which the display stand 10 may be exposed during its expected useful lifetime, but also have a reasonably acceptable or even attractive appearance at least as the surfaces are concerned that will be visible during the use of the display stand 10 in its position revealed in FIG. 3 of the drawing so as not to detract from the esthetic appeal of the display and/or of the goods or items that are being held or supported on the display stand 10 while they are being offered for sale to the public.

The main body 11 typically is of one piece, with its lateral portions being joined with one another in any manner known in or customarily used by the packaging industry, such as by gluing or stapling, to obtain the configuration of a circumferentially complete sleeve. However, there is nothing that would prevent the making of the main body 11 of more than one piece (with the attendant increase of the locations at which such pieces are to be connected with one another). Yet, the economics of the manufacture of the main body 11 appear to militate against this possibility at the moment in the absence of some good reason for taking this course of action.

As already briefly mentioned before, the display stand 10 is shown in FIG. 1 of the drawing in its flat condition (actually, in its flattened, rather unstable, condition that it has been caused to assume during or shortly after its manufacture from the aforementioned sheet material, and in which it remains while being stored and/or transported from one location to another and ultimately to the final destination at which it is to be used, at which point it is then allowed or caused to change its state to its fully deployed condition in which it is ready to receive and hold or at least support the goods or items that are to be presented to the public for consideration and purchase. How exactly this change of condition is brought about will be explained later; before that is done, however, the various features, portions and elements constituting the display stand, and their relative positions and physical as well as functional connections with one another will be addressed presently.

Figure 2:
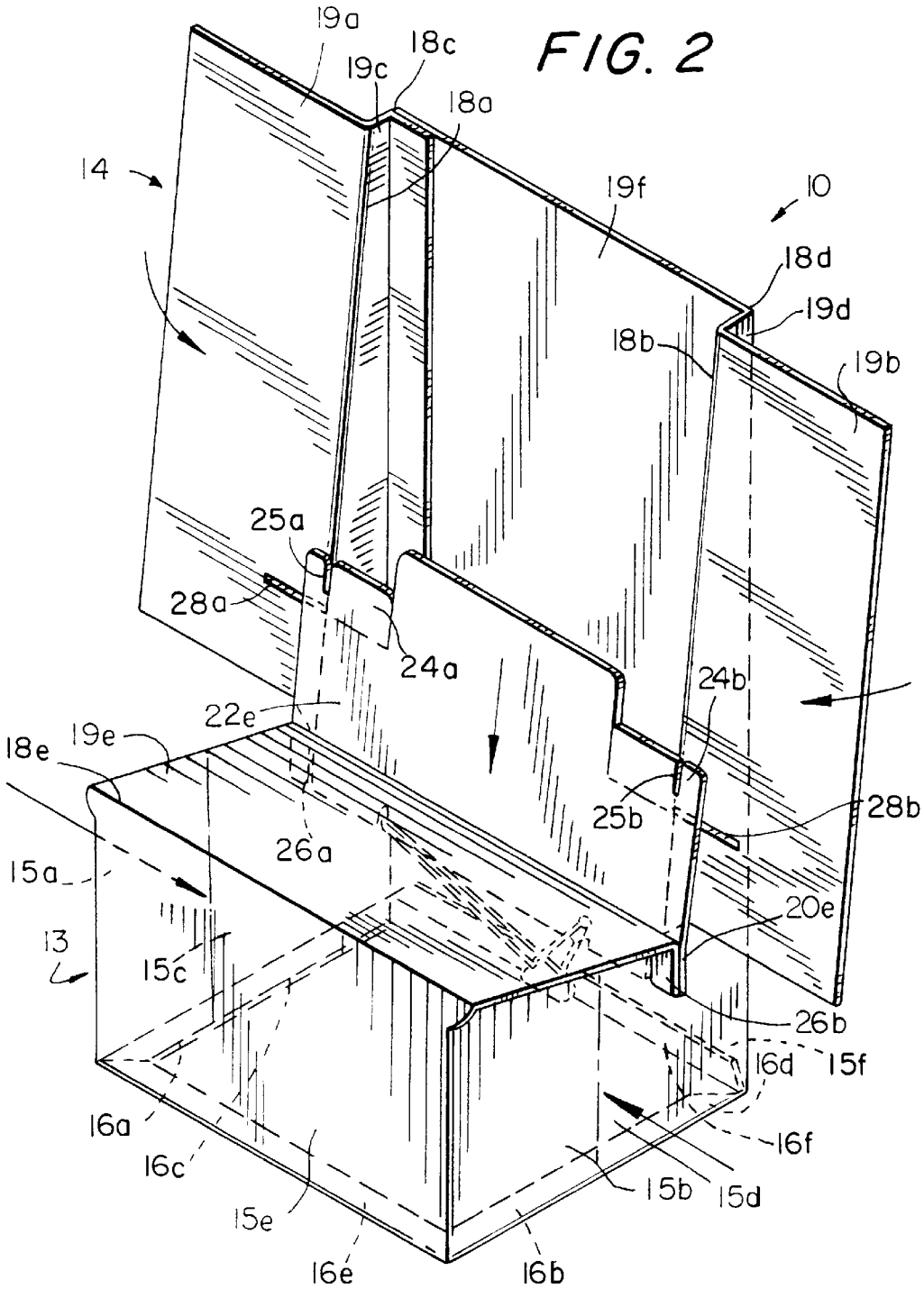
FIG. 2 is a perspective view of the display stand of FIG. 1 in its erected but not yet completely, deployed condition.

As mentioned before, the main body 11 has a sleeve-shaped configuration, which means that not only the resilient elements 12*a* and 12*b* but also certain portions of the main body 11 are either fully obscured by or not that well visible behind different portions of the very same body 11 in FIG. 1, so that FIG. 2 of the drawing may have to be consulted before the positions that the various portions of the main body 11 assume with respect to one another can be fully appreciated.

In any event, it may be rather clearly perceived from FIG. 1 of the drawing that the main body 11 includes a base or pedestal 13, and a superstructure 14. What is visible in FIG. 1 as far as the pedestal 13 is concerned are two lateral portions 15*a* and 15*b*, and a front central portion 15*e* interposed between and hingedly connected with the lateral portions 15*a* and 15*b*. What cannot be seen in FIG. 1 because of the aforementioned obscuration, are respective additional lateral portions 15*c* and 15*d* and a rear portion 15*f* situated behind the lateral portions 15*a* and 15*b* and the front portion 15*e*, respectively and in that order. Neither one of the portions 15*c*, 15*d* and 15*f* necessarily conforms in shape to the respective portion 15*a*, 15*c* and 15*a* that is in front of it; as shown, portions 15*c* and 15*d* certainly do not, for reasons that will be explained later.

In any event, the portions 15*c* and 15*d* are hingedly joined not only to the rear portion 15*f* but to the lateral portions 15*a* and 15*b*, respectively, as well. In the completely folded position of the main body 11 that is shown in FIG. 1, the base portions 15*a*, 15*e* and 15*b* also hide behind themselves respective trapezoidal extensions 16*a*, 16*e* and 16*b* which, even though shown in dash-dotted lines only, have nevertheless been identified by their respective reference numerals. Similar identification has also been provided in FIG. 1 already for respective slits 17*c* and 17*d* that are provided in an upwardly open-ended fashion in the respective additional lateral portions 15*c* and 15*d*.

Turning now to the superstructure 14, it ought to be mentioned first that the "front" portion of the superstructure 14 that is connected to the front portion 15*e* of the base 13 by a weakened hinge portion or crease line 18*e*, actually includes three main sections 19*e*, 20*e* joined to the section 19*e* by a crease line 21*e*, and 22*e* joined to the section 20*e* by a crease line 23*e*. Of these sections 19*e*, 20*e*, and 22*e*, only the section 22*e* (actually, only its part) becomes a "front portion" of sorts in the fully deployed display stand 10 as shown in FIG. 3 because it is located in front of something else in the fully deployed display stand 10. Yet, on the other hand, this "front" section 22*e* is pretty far in the back in the erected display stand 10 and in actual use is often concealed either fully or to a significant extent by the items on display on the display stand 10.

In contradistinction to that, the section 19*e* eventually extends substantially horizontally (actually, it has a slight slant to the rear in the illustrated embodiment, but this slant is intended to be embraced by the word "substantially" when used in conjunction with the word "horizontal" as applied to the section 19*e*), and the section 20*e* even depends downwardly from the section 19*e*, at the rear end zone of the latter, so that by no stretch of the imagination can the section 20*e* possibly be considered to be a "front" section in the partially or fully deployed display stand 10.

It also ought to be mentioned here for the sake of completeness that the section 22*e* has hingedly connected to it a pair of locking tabs 24*a* and 24*b* that are provided with respective open-ended slits 25*a* and 25*b*. Last but not least, it is to be mentioned in this context that the section 20*e* is actually located behind the section 19*e* in FIG. 1, and that two slots 26*a* and 26*b* are provided in the sections 20*e* and 22*e*, extending basically symmetrically across the crease line 23*e*. Also worthy of note are respective projections or noses 27*a* and 27*b* that make it possible for the sections 19*e*, 20*e* and 22*e* to be wider than the section 15*e* (and, even more importantly, as will be seen, than the distance between the side walls of the base 13 as constituted by the side portions 15*a* to 15*d*).

Other than that, the superstructure 14 includes a central rear portion 19*f*, two "actual" side portions 19*c* and 19*d* that are articulated to the central rear portion 19*f* by respective crease lines 18*c* and 18*d*, and two "quasi" side portions (because they are eventually located at the front of the superstructure 14) beating the designations 19*a* and 19*b* which, in turn, are pivotably connected to the side portions 19*c* and 19*d*, respectively, by crease lines 18*a* and 18*b*. Attention is being hereby directed to the fact that the side portions 15*a* and 15*b* are not rectangular but rather trapezoidal, in that their upper edges extend at a predetermined angle down as considered in the respective outward direction, that this trend of the upper edge is continued on the adjacent side portion 15*c* or 15*d* (flipping the latter for this purpose mentally over so that they constitute respective extensions of the side portions 19*a* or 19*b*) for part of the way (to the slits 17*c* and 17*d*, respectively), that the crease lines 18*a* and 18*b* deviate by substantially the same angle from the vertical, and that the portions 19*a* and 19*b* are substantially rectangular, so that their upper and lower edges extend at the very same angle with respect to the horizontal in their positions illustrated in FIG. 1 of the drawing.

The display stand 10 is shown in its already erected and yet only partially deployed condition in FIG. 2 of the drawing. It may be seen there that the base or pedestal 13 has already been completed in that its front and rear portions 15*e* and 15*f* have been moved apart and their side portions 15*a*, 15*c* and 15*b*, 15*d* have been moved into positions in which they constitute respective continuations of one another. The central section 19*e* had already been placed on top of the base 13 and, because of its increased width that exceeds the spacing of the side portions 15 from one another, it securely rests on the upper edges of the side portions 15. The aforementioned slant of the upper edges of the side portions 15 brings about the rearwardly downward slant exhibited by the section 19*e* that had already been mentioned before.

Also, the section 20*e* had already been dropped down, as a result of which respective upper edge regions of the side portions 15 have been received in the slots 26*a* and 26*b*, respectively, thus preventing undesirable collapse of the side portions 15. Moreover, the "front" section 22*e* already extends upwardly, but the superstructure 14 is neither fully deployed, nor locked, in position at this stage of deployment. It is, however, to be noted that it is clearly visible in FIG. 2 that the crease lines 18*a* and 18*b* lean backwards as considered from the bottom to the top end. This angle of repose advantageously substantially corresponds to the rearward slant of the section 19*e*.

FIG. 3 substantially corresponds to FIG. 2, so that only the differences between them need be discussed here. It may be seen that the portions or sections 19*a* and 19*b* have already been turned and inserted through slots 28*a*, 28*b* formed in the side portions 19*a*, 19*b* and placed behind the portion 22*e* (this requires human intervention) and the locking tabs 24 have been turned so as to lock the entire superstructure 14 in place. For a reason that should be obvious, the sections 19*a* and 19*b* slant rearwardly as viewed from below to above. Together, these two slants (that of the section 19*e* and those of the sections 19*a* and 19*b*) cause any items that may be resting on the upwardly facing surface of the section 19*e* while being offered to customers by being prominently displayed on the display stand 10 assure that such items will not slide off of the section 19*e* (if anything, they would slide to the rear until they came into abutment with the sections 19*a* and 19*b* or at least one of them to be stopped by such a physical contact.)

Figure 4:
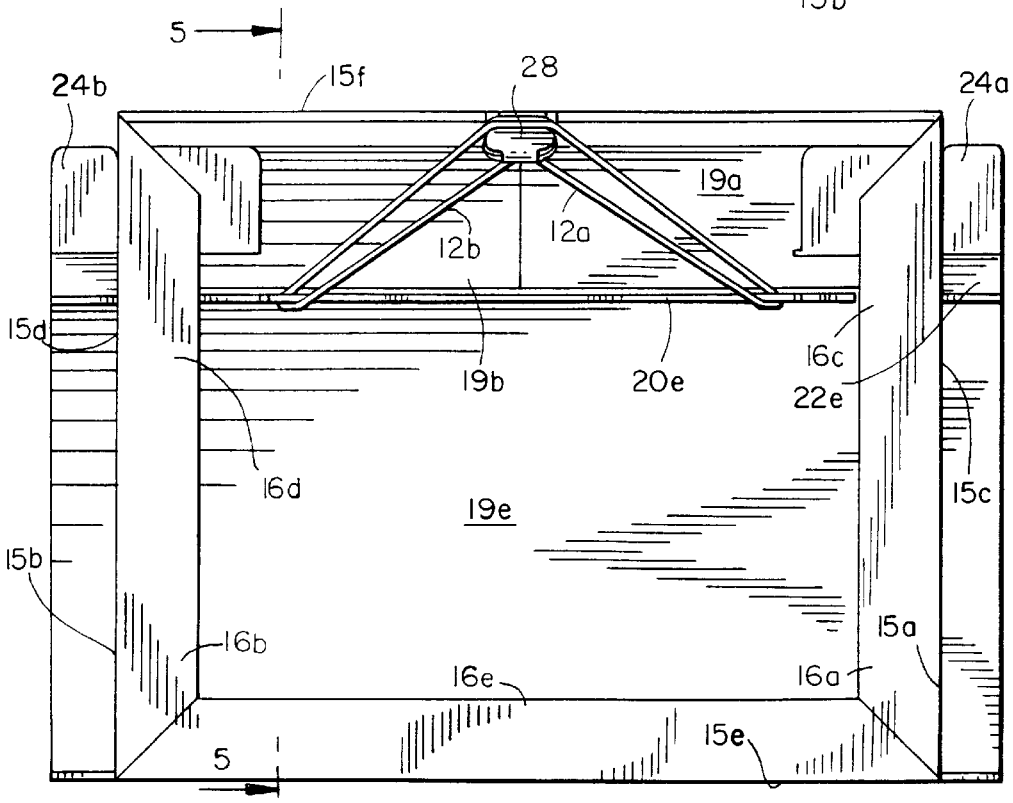
FIG. 4 is a bottom plan view taken in the direction of the arrows 4—4 of FIG. 3 but showing the display container on an enlarged scale.

FIG. 4 of the drawing adds to what had already been mentioned and shown before, namely a specific showing of the extensions 16*a* to 16*f* and the engagement of the elongated resilient elements 12*a* and 12*b* with the various parts of the main body 11, especially with a boss 28 that is provided at the extension 16*f*. At this point, it is advisable to point out something that was readily apparent from the FIGS. previously considered, namely that the resilient elements 12*a* and 12*b* are preferably (but not necessarily) endless; it is currently preferred to utilize rubber bands for this purpose.

Further details of this elastic element mounting on the main body 11 are shown in FIGS. 6 and 7 of the drawing, especially when considered in conjunction with FIG. 5. So, for instance, FIG. 6 shows that the lower region of the sections 20*e* and 22*e* are provided with through openings (collectively referred to by the reference numeral 29). These openings 29 are connected with the periphery of the folded section 20*e* and 22*e* assembly by respective slots 30, through which the endless rubber band 12 can be introduced into the openings 29. It ought to be noticed that the slots 30 are located at an angular distance away from the direction in which the rubber band 12*b* is being pulled, so that inadvertent extraction of the rubber band 12 out of the opening 29 is, by and large, rendered impossible. The situation is similar in FIG. 7, except that there are provided two openings 31*a* and 31*b* and two slots 32*a* and 32*b*, forming the boss 28 between themselves. It may be seen that the rubber bands or similar resilient or elastic elements 12 are actually trained (partially wrapped around) the boss 28.

It will be realized by observing especially FIG. 5 that the two rubber bands 12, by being anchored at the bottom of the rear section 19*f* and by exerting their built-in force on the lower regions of the section 22*e*, is at least extremely helpful if not instrumental in bringing about the erection of the main body 11 into its state shown in FIG. 2. This is especially true because the rubber bands 12, by being connected directly between the sections or portions 19*f* and 22*e*, exert their force immediately at a region of the body 11 where it will do the most good, rather than acting on some other portions, such as the side portions, and waiting and hoping for them to indirectly bring the portions like that indicated at 22*e* into their desired positions.

It will be understood that each of the elements described above, or two or more together, may also find a useful application in other types of constructions differing from the type described above.

While the present invention has been described and illustrated herein as embodied in a specific construction of a rapid-deployment display stand, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A display stand erectable from a collapsed condition to an erect condition, comprising:

a) a front panel;

b) a rear panel having a lower base region overlying the front panel in the collapsed condition, and spaced away from the front panel in the erect condition;

c) a pair of side panels pivotably interconnecting the front panel and the rear panel, said side panels extending perpendicular to the front panel and the rear panel in the erect condition, said side panels having upper edges and upwardly open-ended slits;

d) a shelf panel resting on the upper edges of the side panels in the erect condition, said shelf panel having a front region pivotably connected to the front panel, and a rear region received in the slits of the side panels, and said shelf panel being elevated relative to the lower base region of the rear panel in the erect condition; and e) a pair of elastic elements connected to the rear region of the shelf panel at spaced-apart locations along the rear region, said elastic elements being connected to the lower base region of the rear panel at a common location, said elastic elements extending between the rear region of the shelf panel and the lower base region of the rear panel, said elastic elements being operative for holding the rear region of the shelf panel under tension in place in the slits of the side panels.

2. The display stand as defined in claim 1, wherein the rear panel has an upper region extending upwardly from the shelf panel in the erect condition; and wherein an auxiliary support panel is pivotably connected to the rear region of the shelf panel and extends upwardly from the shelf panel in the erect condition.

3. The display stand as defined in claim 1, wherein all of said panels are constituted of a single piece of corrugated board sheet material.

4. The display stand as defined in claim 1, wherein each of the elastic elements is a rubberband.

* * * * *